US011098675B2

(12) United States Patent
Schmieder et al.

(10) Patent No.: US 11,098,675 B2
(45) Date of Patent: Aug. 24, 2021

(54) PISTON

(71) Applicant: Mahle International GmbH, Stuttgart (DE)

(72) Inventors: Benjamin Schmieder, Stuttgart (DE); Jakob Wissler, Stuttgart (DE)

(73) Assignee: Mahle International GmbH

( * ) Notice: Subject to any disclaimer, the term of this patent is extended or adjusted under 35 U.S.C. 154(b) by 0 days.

(21) Appl. No.: 17/010,794

(22) Filed: Sep. 2, 2020

(65) Prior Publication Data

US 2021/0062755 A1 Mar. 4, 2021

(51) Int. Cl.

| | |
|---|---|
| ***F01P 3/04*** | (2006.01) |
| ***F01P 3/06*** | (2006.01) |
| ***F02F 3/22*** | (2006.01) |

(52) U.S. Cl.
CPC . *F02F 3/22* (2013.01); *F01P 3/06* (2013.01)

(58) Field of Classification Search
CPC ..... F01P 1/04; F01P 3/06; F02F 3/22; F16J 15/3404
See application file for complete search history.

(56) References Cited

U.S. PATENT DOCUMENTS

| | | | | |
|---|---|---|---|---|
| 2,720,193 | A * | 10/1955 | Maybach | F02F 3/22 123/41.36 |
| 4,577,595 | A | 3/1986 | Deutschmann et al. | |
| 5,815,906 | A * | 10/1998 | Johnsen | F16B 19/1054 29/524.1 |
| 6,634,278 | B2 | 10/2003 | Bochart | |
| 6,722,263 | B2 | 4/2004 | Keller et al. | |
| 8,939,114 | B2 | 1/2015 | Keller | |
| 9,341,137 | B2 | 5/2016 | Leitl | |
| 10,240,557 | B2 | 3/2019 | Boczek et al. | |
| 2005/0115523 | A1 | 6/2005 | Bauer | |
| 2007/0113802 | A1 | 5/2007 | Mihara | |
| 2009/0288618 | A1 | 11/2009 | Issler et al. | |
| 2013/0205577 | A1* | 8/2013 | Soller | B21J 15/326 29/525.06 |
| 2017/0030291 | A1* | 2/2017 | Muller | F02F 3/22 |
| 2018/0119636 | A1* | 5/2018 | Keller | B23K 20/129 |
| 2019/0184535 | A1* | 6/2019 | Welch | B25B 27/143 |

FOREIGN PATENT DOCUMENTS

| | | | |
|---|---|---|---|
| DE | 7203513 | U | 5/1972 |
| DE | 33 38 419 | A1 | 5/1985 |
| DE | 19960913 | A1 | 6/2001 |
| DE | 10247218 | A1 | 7/2003 |
| DE | 10214830 | A1 | 1/2004 |
| DE | 102004029927 | A1 | 1/2006 |
| DE | 112004002568 | T5 | 11/2006 |

(Continued)

OTHER PUBLICATIONS

English abstract for DE-10 2012 211 060.

(Continued)

*Primary Examiner* — Long T Tran
(74) *Attorney, Agent, or Firm* — Fishman Stewart PLLC

(57) ABSTRACT

A piston for an internal combustion engine may include a cooling duct having at least one feed opening. The piston may also include a feed funnel arranged within the at least one feed opening. The feed funnel may be fixed in the at least one feed opening via a blind rivet connection.

20 Claims, 2 Drawing Sheets

(56) References Cited

FOREIGN PATENT DOCUMENTS

| | | | |
|---|---|---|---|
| DE | 10 2006 013 884 | A1 | 9/2007 |
| DE | 102009039217 | A1 | 3/2011 |
| DE | 10 2009 056 922 | A1 | 6/2011 |
| DE | 102011106379 | A1 | 1/2013 |
| DE | 102011106381 | A1 | 1/2013 |
| DE | 10 2012 211 060 | A1 | 4/2014 |
| DE | 102014015946 | A1 | 5/2016 |

OTHER PUBLICATIONS

English abstract for DE-10 2009 056 922.
English abstract for DE-102004029927.
English abstract for DE-102009039217.

* cited by examiner

PISTON

CROSS-REFERENCE TO RELATED APPLICATIONS

This application claims priority to German Patent Application No. DE 10 2019 213 358.4, filed on Sep. 3, 2019, the contents of which is hereby incorporated by reference in its entirety.

TECHNICAL FIELD

The present invention relates to a piston for an internal combustion engine with a circumferential cooling duct. Moreover, the invention relates to a feed funnel for a piston of this type, and to a method for mounting a feed funnel of this type in a piston.

BACKGROUND

DE 10 2006 013 884 A1 has disclosed a piston of the generic type for an internal combustion engine, which piston has a piston head and a piston skirt, a circumferential cooling duct being configured between the piston head and the piston skirt. A feed funnel is likewise provided, via which cooling oil is fed into the cooling duct.

DE 33 38 419 A1 has disclosed a further piston for an internal combustion engine with a circumferential cooling duct and a feed opening, a feed funnel being arranged in the feed opening. Here, the feed funnel is screwed into the feed opening. This represents a considerable disadvantage, however, since an internal thread first of all has to be cut into the feed opening in order to mount the feed funnel. Moreover, the feed funnel has to have an external thread which is of complementary configuration with respect to it, which results in complex manufacture.

DE 10 2012 211 060 A1 has disclosed a further piston for an internal combustion engine, which further piston likewise has a screwed-in or pressed-in feed funnel in a feed opening of a cooling duct. It is also the case here that either a corresponding thread has to be provided, or else a corresponding fit accuracy, in order for it to be possible for a predefined press fit connection to be established.

DE 10 2009 056 922 B4 has disclosed a piston with a feed funnel for cooling oil in a cooling duct, the feed funnel being hooked in a joint region between two cooling duct covering parts.

SUMMARY

The present invention is concerned with the problem of specifying at least one improved alternative embodiment for a piston of the generic type, which alternative embodiment provides, in particular, readily accessible and simple but nevertheless reliable mounting of a feed funnel in a feed opening for a cooling duct in a piston.

According to the invention, said problem is solved by way of the subject matter of the independent claim(s). Advantageous embodiments are the subject matter of the dependent claim(s).

The present invention is based on the general concept of fixing a feed funnel in a feed opening of a cooling duct of a piston by means of a simple blind rivet connection which is also accessible, in particular, from a single side, namely the underside of the piston. As a result, the fixing of the feed funnel by way of setting of the blind rivet connection is possible in an extremely simple manner, it being possible for the blind rivet connection to be configured as a conventional blind rivet connection or as a blind rivet nut connection. In particular, access from the cooling duct is not required as a result of a blind rivet connection of this type, with the result that the feed funnel can also be used in a cooling duct which is produced by way of a salt core and is subsequently drilled out through the feed opening. Fixing of this type of the feed funnel in the feed opening also represents an extremely inexpensive solution which, in particular, is considerably less expensive than, for example, welding or brazing of a feed funnel of this type in the feed opening.

In the case of one ongoing development of the solution according to the invention, the feed opening is configured as a bore in the piston, or the cooling duct is closed by means of a cooling duct covering, for example by means of a cooling duct plate, the feed opening being configured as a through opening in the cooling duct covering. It can already be seen from this list that the feed funnel which is fixed according to the invention in the feed opening by means of the blind rivet connection can be used regardless of the configuration of the piston and also regardless of the configuration, for example, of a cooling duct or a cooling duct covering. Thus, for example, the feed opening can be configured as a bore which is made retrospectively in the piston, it also being conceivable as an alternative that a feed opening of this type is provided as a through opening in the cooling duct covering.

As an alternative to this, it is also conceivable that the cooling duct is closed by means of a two-piece cooling duct covering with a first cooling duct covering part and a second cooling duct covering part, the feed opening being provided in this case at a joint of the two cooling duct covering parts. In this case, the feed opening can be produced particularly simply, for example by means of a corresponding punching process, in the case of which a semicircle is punched out on each cooling duct covering part, which semicircles together form the feed opening in the case of cooling duct covering parts which abut one another.

In the case of one ongoing development of the solution according to the invention, the blind rivet connection is configured as a blind rivet nut connection, the feed funnel having an annular collar and, at its end which faces away from a funnel, a first internal thread, a first upset region being provided between said first internal thread and the annular collar. Here, the blind rivet nut connection is a special form of blind rivet connection, in the case of which the blind rivet nut is first of all screwed onto a threaded mandrel of the blind rivet setting tool, and is subsequently plugged into the feed opening until it bears with its annular collar against an edge of the feed opening. Subsequently, the threaded mandrel is withdrawn and the upset region is bulged in the process, as a result of which an edge of the feed opening is clamped in firstly between the annular collar and the bulged upset region, and the feed funnel is fixed in the feed opening via this. Finally, the threaded mandrel is removed again from the first thread of the feed funnel by way of rotating of said threaded mandrel in the opposite direction, whereupon said feed funnel remains in a finally fixed state in the feed opening.

As an alternative, it goes without saying that it is also conceivable that the feed funnel is configured in the manner of a blind rivet, it then first of all being plugged into the feed opening for mounting purposes until it bears with its annular collar against the feed opening. Subsequently, the rivet mandrel is pulled until the upset region is bulged and the feed funnel is fixed in the feed opening via the blind rivet connection. In this case, the feed funnel would subsequently still have to be drilled through, which can likewise be produced simply in terms of manufacturing technology, however.

In the case of one ongoing development of the solution according to the invention, the feed funnel has an axial length L of 10 mm≤L≤35 mm, a length range of this type covering virtually all application variants. Furthermore, a funnel length $L_T$ can be varied between preferably 6 and 16 mm, as a result of which a different degree of oil catching of the feed funnel (oil catching funnel) can be achieved.

In addition or as an alternative, it can also be provided that the feed funnel has a maximum diameter $D_{max}$ of 10 mm≤$D_{max}$≤14 mm. As a result, virtually all size ranges of common pistons can be covered. The greater the maximum diameter $D_{max}$ here, the more oil which can be collected, for example, and can be fed to the cooling duct.

In addition or as an alternative, it is also conceivable that the feed funnel has a standpipe internal diameter $D_{SI}$ of from approximately 2 to 8 mm. As a result, a sufficient supply of the cooling duct with oil is feasible.

Furthermore, the present invention is based on the general concept of configuring a feed funnel as a blind rivet or as a blind rivet nut, the blind rivet nut representing a special type of blind rivet. As a result, comparatively simple and nevertheless reliable mounting of the feed funnel in an associated feed opening of a cooling duct of a piston is possible, combined with the advantage that a feed funnel of this type can be fixed in the feed opening and can be mounted as a result from one side, that is to say, for example, the underside of the piston.

In the case of the advantageous development of the solution according to the invention, the feed funnel has an annular collar and, at its end which faces away from a funnel of the feed funnel, an internal thread, a first upset region being provided between the internal thread and the annular collar. In this case, the feed funnel is configured as a blind rivet nut. An embodiment of this type affords the great advantage that, after mounting of the feed funnel, the threaded mandrel of the blind rivet setting tool can be screwed out more simply and, as a result, the through opening can already be produced.

As an alternative, it is also conceivable that the blind rivet connection is configured as a blind rivet nut connection, and the feed funnel has an internal thread at its end which faces away from the funnel, a first and a second upset region lying between the funnel and the internal thread. In this case, therefore, the second upset region forms the annular collar which is formed in the above-described alternative embodiment. In this case, therefore, a threaded mandrel is screwed through the funnel into the thread at the free end of the feed funnel from the funnel, and is plugged through the feed opening on the piston in this state, in which it is screwed on the threaded mandrel. Subsequently, the threaded mandrel is either withdrawn axially, the feed funnel being held on the funnel or at another point via an abutment, for example the blind rivet setting tool, or the mandrel (threaded mandrel) bringing about upsetting of the feed funnel in the axial direction by way of rotation. A deformation of the upset regions which takes place one after another can be achieved by way of different stiffnesses of the two upset regions, for example a weaker stiffness of the second upset region in comparison with the first upset region, the two upset regions clamping in the feed funnel on/in the feed opening in the end. Subsequently, the threaded mandrel is screwed out and removed. A common feature here of the two embodiments is that rapid, reliable and simple fixing of the feed funnel in the feed opening is made possible in this way.

Furthermore, the present invention is based on the general concept of specifying a method for mounting a feed funnel in a piston, in the case of which method the feed funnel is first of all plugged with its end which faces away from a funnel of the feed funnel into a feed opening of the cooling duct of the piston, and the feed funnel is subsequently fixed in said feed opening by means of a blind rivet connection. As a result, simple and nevertheless at the same time reliable mounting or fixing of the feed funnel in the feed opening can take place.

Here, for example, a feed funnel which is configured as a blind rivet nut can be used, in the case of which feed funnel mounting in the feed opening takes place as follows: first of all, the feed funnel is screwed onto a threaded mandrel of a blind rivet setting tool, and is subsequently plugged into the feed opening of the piston until it bears with its annular collar against an edge of the feed opening. Subsequently, the threaded mandrel is withdrawn by means of the blind rivet setting tool, and an upset region of the feed funnel which lies between the annular collar and the internal thread is bulged, as a result of which a fixed clamped connection is produced between the feed funnel and the edge of the feed opening. Subsequently, the threaded mandrel is screwed out of the internal thread of the feed funnel. In this way, the feed funnel is attached in a finally fixed manner in the feed opening.

In the case of one alternative embodiment, it is also purely theoretically conceivable that the feed funnel is configured as a blind rivet, it then being plugged first of all with its rivet mandrel into the blind rivet setting tool for mounting purposes, and subsequently being inserted into the feed opening. The riveting mandrel is then pulled on until it breaks at a predetermined break point, and the at least one upset region is bulged. As a result, the feed funnel is fixed firmly in the feed opening via the blind rivet connection. Subsequently, a through opening still has to be produced, for example by means of drilling.

Further important features and advantages of the invention result from the subclaims, from the drawings and from the associated description of the figures on the basis of the drawings.

It goes without saying that the features which are mentioned in the above text and are still to be described in the following text can be used not only in the respective specified combination, but rather also in other combinations or on their own, without departing from the scope of the present invention.

Preferred exemplary embodiments of the invention are shown in the drawings and will be described in greater detail in the following description, identical reference numerals relating to identical or similar or functionally identical components.

BRIEF DESCRIPTION OF THE DRAWINGS

In the drawings, in each case diagrammatically.

DETAILED DESCRIPTION

Figure 1A:
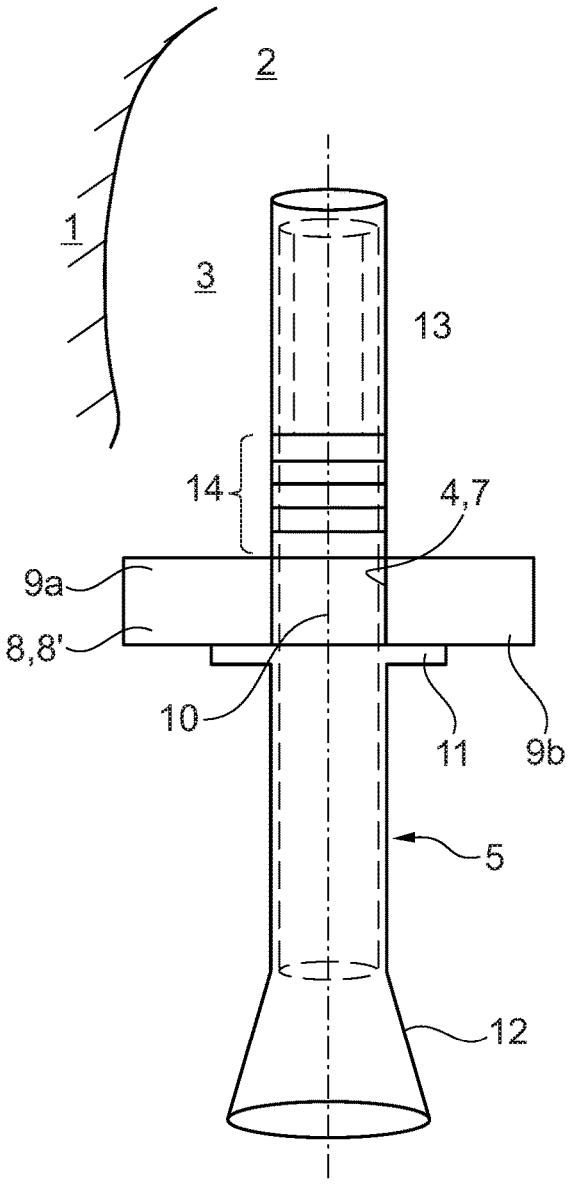
FIG. 1*a* shows a sectional illustration through a piston according to the invention with a feed funnel according to the invention in accordance with a first embodiment, in a way which is not yet fixed in a feed opening.

In accordance with FIGS. 1 and 2, a piston 1 according to the invention for an internal combustion engine 2 (not shown in greater detail) has a cooling duct 3 which has at least one feed opening 4 with a feed funnel 5 which is arranged therein. According to the invention, said feed funnel 5 is then fixed in the feed opening 4 by means of a blind rivet connection 6 (cf. FIGS. 1 and 2). This affords the great advantage that simple mounting and fixing of the feed funnel 5 in the feed opening 4 is possible from only a single side, for example an underside of the piston. In addition, further, in particular complex, fixing operations are dispensed with, such as riveting, welding or brazing of the feed funnel 5.

Here, the feed opening 4 can be configured as a bore in the piston 1, or else the cooling duct 3 is closed from below by means of a cooling duct covering 8, the feed opening 4 being configured as a through opening 7 in the cooling duct covering 8. Here, according to FIGS. 1 and 2, in each case merely one feed opening 4 is shown in a cooling duct covering 8; it goes without saying that the other embodiment is readily comprehensible to a person skilled in the art. The cooling duct 3 can be closed, for example, by way of a two-piece cooling duct covering 8' with a first cooling duct covering part 9*a* and a second cooling duct covering part 9*b*, it then being possible for the feed opening 4 to be provided at a joint 10 of the two cooling duct covering parts 9*a*, 9*b*, which simplifies the production of the feed opening 4 considerably, since merely a semicircle has to also be punched out in the two cooling duct covering parts 9*a*, 9*b*, which semicircles form the through opening 7 or the feed opening 4 in the assembled state.

Figure 1B:
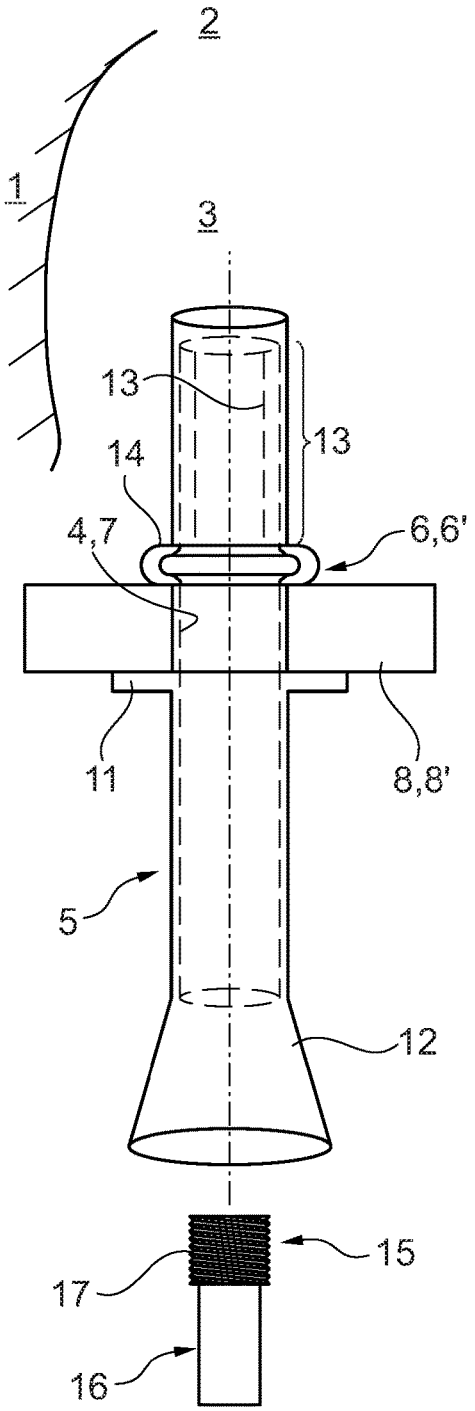
FIG. 1*b* shows an illustration as in FIG. 1*a*, but after fixing.

If the feed funnel 5 is looked at more closely, it can be seen that, in the present case according to FIGS. 1*a* and 1*b*, it has an annular collar 11 which serves as a stop in the case of the feed funnel 5 being pushed into the feed opening 4. A feed funnel 5 of this type likewise has an internal thread 13 at an end which faces away from a funnel 12, a first upset region 14 being arranged between the internal thread 13 and the annular collar 11, which first upset region 14 is upset and in the process bulged to the outside in the case of the production of the blind rivet connection 6. The reshaped upset region 14 and the annular collar 11 therefore clamp the cooling duct covering 8 between them after the blind rivet connection 6 is produced, and reliably fix the feed funnel 5 in the feed opening 4 as a result.

Here, mounting of the feed funnel 5 in the piston 1 or in the feed opening 4 takes place as follows:

First of all, the feed funnel 5 is pushed with its funnel 12 over a threaded mandrel 15 of a blind rivet setting tool 16, and subsequently the internal thread 13 of the feed funnel 5 is screwed to an external thread 17 of complementary configuration with respect to it of the threaded mandrel 15. Subsequently, the threaded mandrel 15 is pushed together with the feed funnel 5 through the feed opening 4 until the feed funnel 5 bears with its annular collar 11 against an underside of the cooling duct covering 8, 8' or against a lower edge of the feed opening 4. Subsequently, axial withdrawal of the threaded mandrel 15 takes place, as a result of which the latter pulls the internal thread 13 downwards and in the process deforms the first upset region 14 plastically to the outside, as shown according to FIG. 1*b*. It goes without saying that the axial withdrawal can purely theoretically also be achieved by way of a corresponding rotational movement of the threaded mandrel 15 in the internal thread 13; it goes without saying that the feed funnel 5 is fixed in the axial direction either, for example, on the annular collar 11 or on its funnel 12 and, as a result, counteracts the axial movement of the internal thread 13 downwards, which axial movement brings about the upset deformation of the first upset region 14. If the blind rivet connection 6 is then produced, the threaded mandrel 15 is rotated in the opposite direction and, as a result, is screwed with its external thread 17 out of the internal thread 13 of the feed funnel 5. Subsequently, the threaded mandrel 15 can be removed. As a result, the feed funnel 5 is fixed reliably in the feed opening 4 of the piston 1. In this case, the blind rivet connection 6 is configured as what is known as a blind rivet nut connection 6'.

Figure 2A:
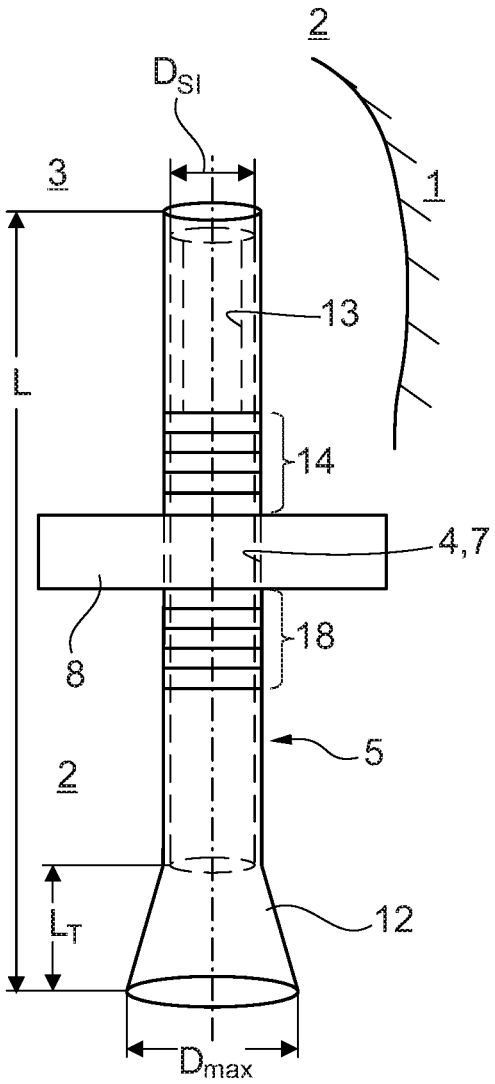
FIG. 2*a* shows an illustration as in FIG. 1*a*, but with a feed funnel with two upset regions.
Figure 2B:
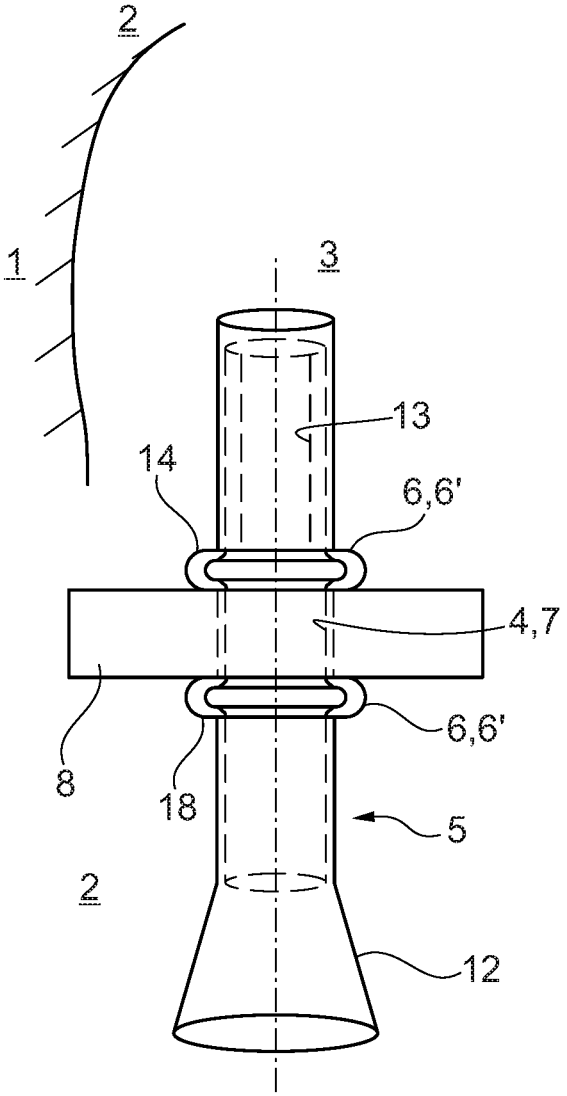
FIG. 2*b* shows an illustration as in FIG. 2*a*, but in the case of a feed funnel which is fixed in the feed opening.

If the feed funnel 5 according to FIGS. 2*a* and 2*b* is considered, it can be seen that it likewise has an internal thread 13 at its longitudinal end which faces away from the funnel 12, a first upset region 14 and, in addition here, also a second upset region 18 once again lying between the funnel 12 and the internal thread 13. In this case, the fixing of the feed funnel 5 in the feed opening 4 can also be produced by means of a blind rivet nut connection 6'. To this end, a threaded mandrel 15 (not shown) is likewise pushed from below into the feed funnel 5 until it can be screwed with its external thread 17 into the internal thread 13 of the feed funnel 5. Subsequently, axial withdrawal of the upper part of the feed funnel 5 takes place, in which upper part the internal thread 13 lies, and at the same time supporting of the lower part of the feed funnel 5 takes place, for example on the funnel 12. As a result of the shortening of the axial length, the two upset regions 14, 18 are bulged and, as a result, the cooling duct covering 8, 8' is clamped in between the two bulged upset regions 14, 18 (cf. FIG. 2*b*). It goes without saying that it can be provided here that the two upset regions 14, 18 have different stiffnesses, for example as a result of correspondingly predefined material weakening, as a result of which upsetting or bulging of the two upset regions 14, 18 after one another can be achieved.

It goes without saying that purely theoretically fixing of the feed funnel 5 via a blind rivet connection 6 is also known, in the case of which the feed funnel 5 still has a rivet mandrel (not illustrated), and is held via the latter on the blind rivet setting tool 16 in a similar manner to a blind rivet. Via this, the feed funnel 5 is plugged into the feed opening 4 until, for example, it bears against an outer edge of the feed opening 4 with its stop, that is to say its annular collar 11. Subsequently, the rivet mandrel (not illustrated) is withdrawn by means of the blind rivet setting tool 16, as a result of which the first upset region 14 is upset and is bulged to the outside and, as a result, the cooling duct covering 8, 8' is clamped in between it and the annular collar 11. In the case of further pulling, the rivet mandrel breaks at a predetermined break point, it then subsequently being necessary, that is to say after the removal of the rivet mandrel, for a through opening through the feed funnel 5 to still be produced, for example to be drilled.

In general, the feed funnel 5 can have an axial length L of between 10 and 35 mm. A funnel length $L_T$ preferably lies between 6 mm and 16 mm (6 mm$\leq L_T \leq$16 mm). A maximum diameter $D_{max}$ of the feed funnel lies between 10 and 14 mm, whereas a standpipe internal diameter $D_{SL}$ is approximately 2-8 mm. As a result of the stated length and diameter specifications, a predefined penetration of cooling oil into the cooling duct 3 can firstly be achieved, and also a predefined cooling oil quantity.

It goes without saying that the invention is intended to protect not only the piston 1 with a feed funnel 5 which is arranged in it according to the invention via a blind rivet connection 6 or a blind rivet nut connection 6', but rather also a feed funnel 5 of this type and the above-described mounting method for fixing it in the feed opening 4.

It is possible by way of the feed funnel 5 according to the invention and the piston 1 according to the invention to achieve a positively locking connection between the feed funnel 5 and the feed opening 4, which positively locking connection makes both simple mounting from merely a single side, namely the underside of the piston, possible, and also reliable fixing of the feed funnel 5 in the feed opening 4. Via this, feed funnels 5 of this type can be produced inexpensively and have a long service life on account of their usually metallic configuration. Here, fixing or setting of the feed funnel 5 in the feed opening 4 can be brought about without problems even by inexperienced workers.

The invention claimed is:

1. A piston for an internal combustion engine, comprising:
a cooling duct having at least one feed opening;
a feed funnel arranged within the at least one feed opening; and
wherein the feed funnel is fixed in the at least one feed opening via a blind rivet connection.

2. The piston according to claim 1, wherein at least one of:
the at least one feed opening is configured as a bore; and
the cooling duct is closed via a cooling duct covering, and the at least one feed opening is configured as a through opening in the cooling duct covering.

3. The piston according to claim 1, wherein:
the cooling duct is closed via a two-piece cooling duct covering having a first cooling duct covering part and a second cooling duct covering part; and
the at least one feed opening is disposed at a joint between the first cooling duct covering part and the second cooling duct covering part.

4. The piston according to claim 1, wherein:
the blind rivet connection is configured as a blind rivet nut connection; and
the feed funnel includes:
an annular collar;
a funnel;
an internal thread disposed at an end of the feed funnel that faces away from the funnel; and
a first upset region disposed between the internal thread and the annular collar.

5. The piston according to claim 1, wherein:
the blind rivet connection is configured as a blind rivet nut connection; and
the feed funnel includes:
a funnel;
an internal thread disposed at an end of the feed funnel that faces away from the funnel; and
a first upset region and a second upset region disposed between the funnel and the internal thread.

6. The piston according to claim 1, wherein the feed funnel has at least one of:
an axial length of 10 mm to 35 mm; and
a funnel length of 6 mm to 16 mm.

7. The piston according to claim 1, wherein the feed funnel has at least one of:
a maximum diameter of 10 mm to 14 mm; and
a standpipe internal diameter of approximately 2 mm to 8 mm.

8. A feed funnel of a piston, wherein the feed funnel is configured as at least one of a blind rivet and a blind rivet nut.

9. The feed funnel according to claim 8, comprising:
a funnel;
an internal thread disposed at an end facing away from the funnel;
a first upset region disposed between the internal thread and the funnel;
at least one of (i) an annular collar and (ii) a second upset region disposed between the funnel and the first upset region; and
wherein the at least one of the blind rivet and the blind rivet nut includes the blind rivet nut.

10. The feed funnel according to claim 9, wherein the feed funnel has at least one of:
an axial length of 10 mm to 35 mm; and
a funnel length of 6 mm to 16 mm.

11. The feed funnel according to claim 9, wherein the feed funnel has at least one of:
a maximum diameter of 10 mm to 14 mm; and
a standpipe internal diameter of approximately 2 mm to 8 mm.

12. A method for mounting a feed funnel in a piston comprising:
plugging an end of the feed funnel, which faces away from a funnel of the feed funnel, into a feed opening of a cooling duct of the piston; and
fixing the feed funnel in the feed opening via a blind rivet connection.

13. The method according to claim 12, wherein the blind rivet connection is a blind rivet nut connection.

14. The piston according to claim 1, wherein the feed funnel includes:
an elongated annular body including a first upset region bulging radially outward therefrom;
a funnel disposed at a first axial end of the annular body; and
an internal thread disposed within the annular body at a second axial end of the annular body.

15. The piston according to claim 14, wherein:
the feed funnel has an axial length of 10 mm to 35 mm;
the funnel has a funnel axial length of 6 mm to 16 mm;
the annular body has an internal diameter of 2 mm to 8 mm; and
an end of the funnel disposed opposite the annular body has a diameter of 10 mm to 14 mm.

16. The piston according to claim 14, wherein the feed funnel further includes an annular collar projecting radially outward from the annular body.

17. The piston according to claim 16, further comprising a cooling duct covering closing the cooling duct, wherein:
the at least one feed opening is configured as a through opening in the cooling duct covering; and
the cooling duct covering is secured axially between the first upset region and the annular collar such that the blind rivet connection is defined by the first upset region and the annular collar.

18. The piston according to claim 14, wherein the annular body further includes a second upset region bulging radially outward therefrom.

19. The piston according to claim 18, further comprising a cooling duct covering closing the cooling duct, wherein:
the at least one feed opening is configured as a through opening in the cooling duct covering; and
the cooling duct covering is secured axially between the first upset region and the second upset region such that the blind rivet connection is defined by the first upset region and the second upset region.

20. The piston according to claim 5, wherein the first upset region and the second upset region of the feed funnel bulge radially outward therefrom.

* * * * *